US011733007B2

(12) United States Patent
Laporte et al.

(10) Patent No.: US 11,733,007 B2
(45) Date of Patent: Aug. 22, 2023

(54) TARGET LAUNCHING MACHINE

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING (SAS), Biot (FR)

( * ) Notice: Subject to any disclaimer, the term of this patent is extended or adjusted under 35 U.S.C. 154(b) by 8 days.

(21) Appl. No.: 17/609,902

(22) PCT Filed: May 7, 2020

(86) PCT No.: PCT/EP2020/062788

§ 371 (c)(1),
(2) Date: Nov. 9, 2021

(87) PCT Pub. No.: WO2020/229322

PCT Pub. Date: Nov. 19, 2020

(65) Prior Publication Data

US 2022/0205764 A1 Jun. 30, 2022

(30) Foreign Application Priority Data

May 10, 2019 (FR) ..... 1904864

(51) Int. Cl.

| | |
|---|---|
| ***F41J 9/18*** | (2006.01) |
| ***F41J 9/32*** | (2006.01) |
| ***F41J 9/30*** | (2006.01) |

(52) U.S. Cl.

CPC .. *F41J 9/32* (2013.01); *F41J 9/30* (2013.01)

(58) Field of Classification Search

CPC ..... F41J 9/18; F41J 9/30; F41J 9/32

(Continued)

(56) References Cited

U.S. PATENT DOCUMENTS 1,369,948 A * 3/1921 Vickery ..... F41J 9/32 248/183.3
1,638,283 A * 8/1927 Bahlmann ..... F41J 9/30 124/46

(Continued)

FOREIGN PATENT DOCUMENTS

| | | |
|---|---|---|
| FR | 2709543 | 3/1995 |
| FR | 3066813 | 11/2018 |

OTHER PUBLICATIONS

International Search Report issued in corresponding International Application No. PCT/EP2020/062788, dated Jul. 15, 2020, pp. 1-3, European Patent Office, Rijswijk, Netherlands.

(Continued)

*Primary Examiner* — Alexander R Niconovich
(74) *Attorney, Agent, or Firm* — Hauptman Ham, LLP

(57) ABSTRACT

A machine for launching targets including a base on which there is arranged an assembly having a launching mechanism and a drum for storing targets, assembly being configured so as to be able to move relative to the base, the machine including a tilting device that allows the assembly to move relative to the base, the tilting device having on one hand a first portion connected to the base and having one from among a curved rail and an element for guiding of the rail in a single degree of freedom of tilting along the rail, and on the other hand a second portion connected to the assembly and having the other from among the rail and the guiding element, wherein it comprises a pivot connection about a rotation axis A2 between the second portion and the rest of the assembly.

11 Claims, 12 Drawing Sheets

(58) Field of Classification Search
USPC ..... 124/6, 7, 8, 9
See application file for complete search history.

(56) References Cited

U.S. PATENT DOCUMENTS

| | | | | | |
|---|---|---|---|---|---|
| 2,242,596 | A * | 5/1941 | Parker | F41J 9/30 | 124/16 |
| 2,310,746 | A * | 2/1943 | Parker | F41J 9/30 | 124/47 |
| 2,432,155 | A * | 12/1947 | Herold | F41J 9/18 | 124/47 |
| 3,420,218 | A * | 1/1969 | Rademacher | F41J 9/20 | 124/43 |
| 3,971,357 | A * | 7/1976 | LaPorte | F41J 9/24 | 124/43 |
| 4,300,520 | A * | 11/1981 | Laporte | F41J 9/32 | 124/9 |
| 4,481,932 | A * | 11/1984 | Olson | F41J 9/20 | 124/43 |
| 5,036,828 | A * | 8/1991 | Heffer | F41J 9/30 | 124/47 |
| 6,588,410 | B1 * | 7/2003 | Graber | F41J 9/24 | 124/8 |
| 7,263,986 | B2 * | 9/2007 | Lovell | F41J 9/30 | 124/9 |
| 7,958,877 | B2 * | 6/2011 | Lalor | A63B 69/408 | 124/16 |
| 8,677,983 | B2 * | 3/2014 | Callander | F41J 5/18 | 124/8 |
| 8,899,216 | B2 * | 12/2014 | Laporte | F41J 9/24 | 124/43 |
| 9,004,055 | B2 * | 4/2015 | Laporte | F41J 9/20 | 124/47 |
| 9,022,016 | B1 * | 5/2015 | Hafer | F41B 4/00 | 124/78 |
| 9,052,169 | B2 * | 6/2015 | Laporte | F41J 9/18 | |
| 9,086,257 | B2 * | 7/2015 | Laporte | F41J 9/20 | |
| 9,163,913 | B2 * | 10/2015 | Laporte | F41J 9/18 | |
| 9,389,050 | B1 * | 7/2016 | Chen | F41J 9/30 | |
| 9,945,644 | B2 * | 4/2018 | Fouques | F41J 9/24 | |
| 10,365,072 | B1 * | 7/2019 | Liu | F41J 9/20 | |
| 10,458,760 | B1 * | 10/2019 | Liu | F41J 9/20 | |
| 10,488,162 | B2 * | 11/2019 | Laporte | F41J 9/30 | |
| 10,545,011 | B1 * | 1/2020 | Collins | F41J 9/18 | |
| 10,634,465 | B2 * | 4/2020 | Laporte | F41J 9/30 | |
| 2011/0260404 | A1 * | 10/2011 | Laporte | F41J 1/01 | 273/362 |
| 2012/0138034 | A1 * | 6/2012 | Whidborne | F41J 9/18 | 124/8 |
| 2013/0133636 | A1 * | 5/2013 | Rennert | F41J 9/18 | 124/80 |
| 2021/0381810 | A1 * | 12/2021 | Laporte | F41J 9/24 | |
| 2022/0178661 | A1 * | 6/2022 | Larsen | F41J 9/18 | |

OTHER PUBLICATIONS

Written Opinion issued in corresponding International Application No. PCT/EP2020/062788, dated Jul. 15, 2020, pp. 1-6, European Patent Office, Rijswijk, Netherlands.

* cited by examiner

[Fig. 1]
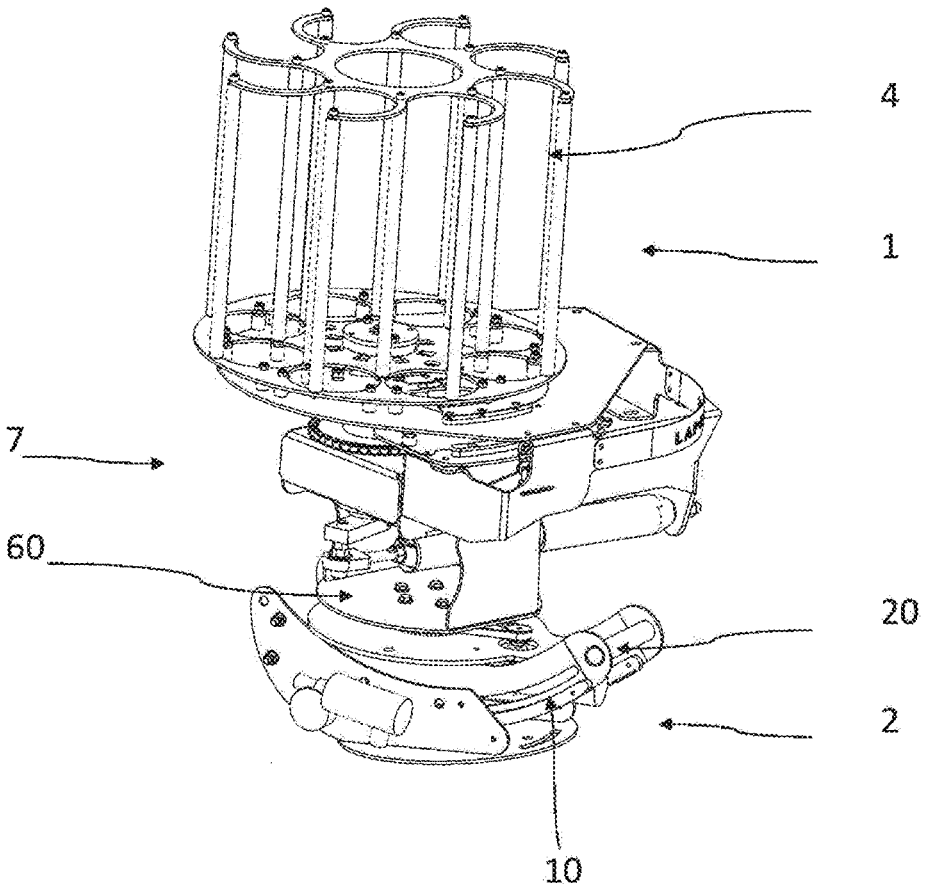

[Fig. 2]
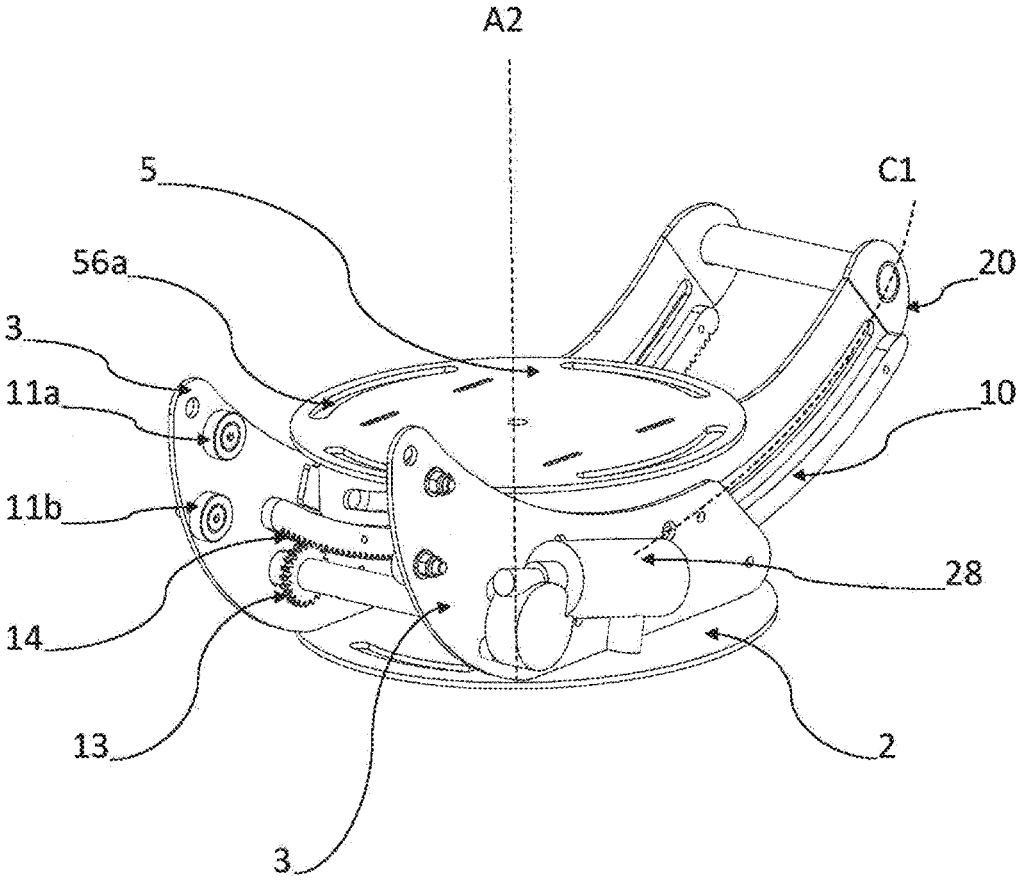

[Fig. 3]
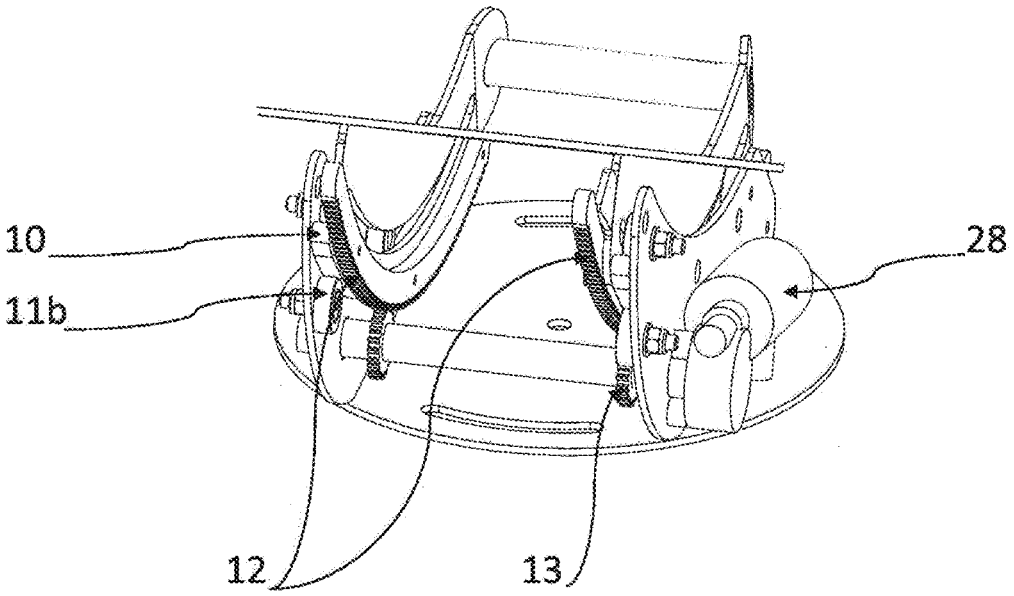
[Fig. 4]
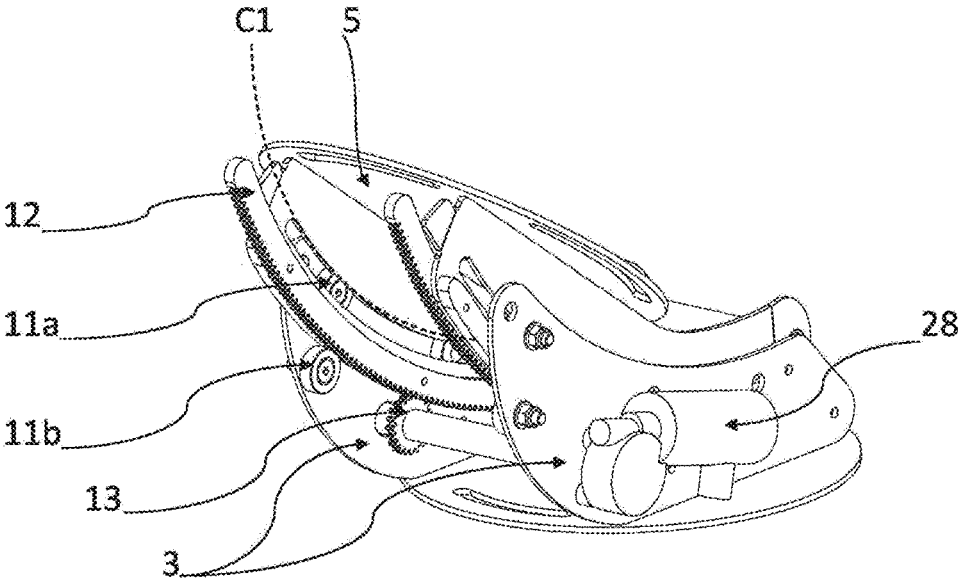

[Fig. 5]
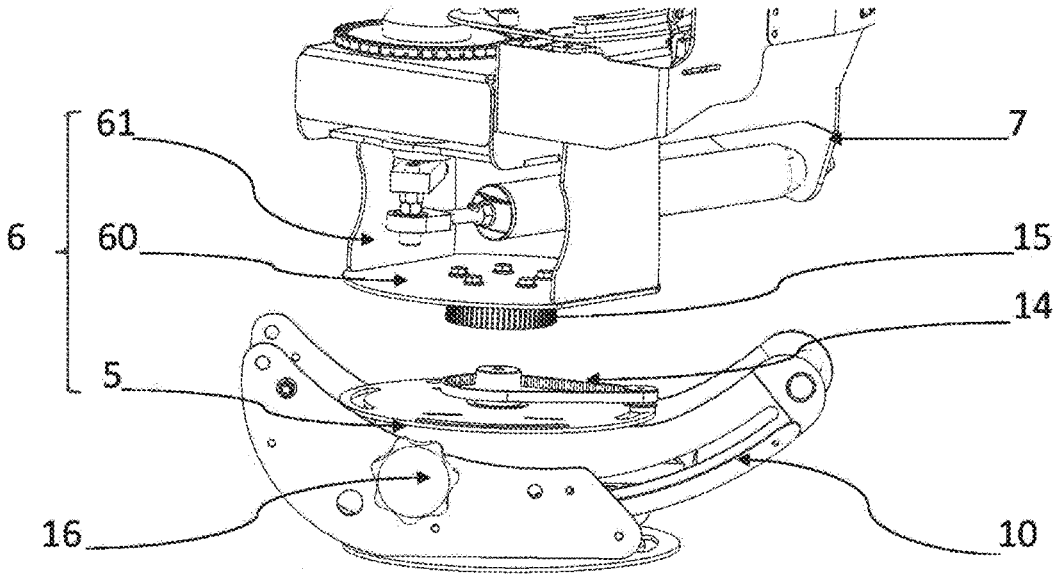
[Fig. 6]
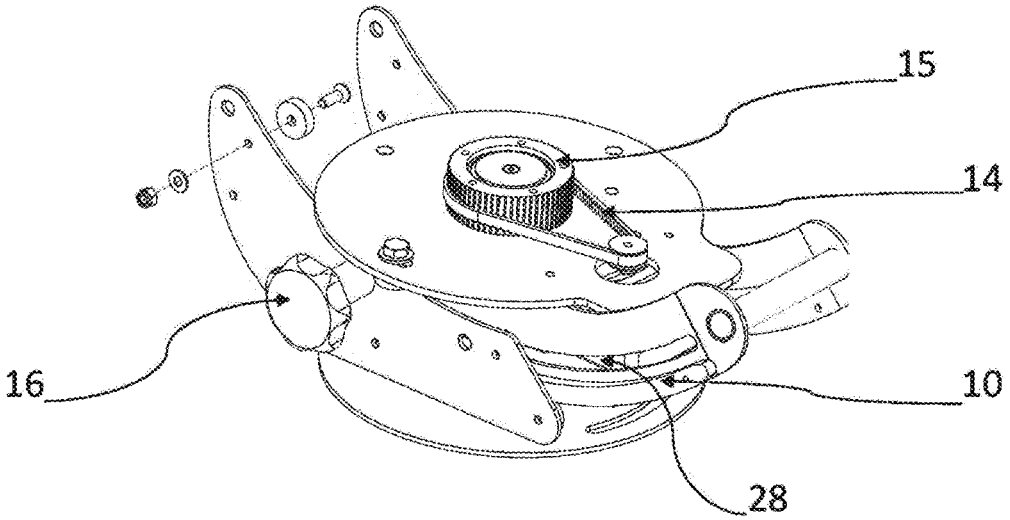

[Fig. 7]
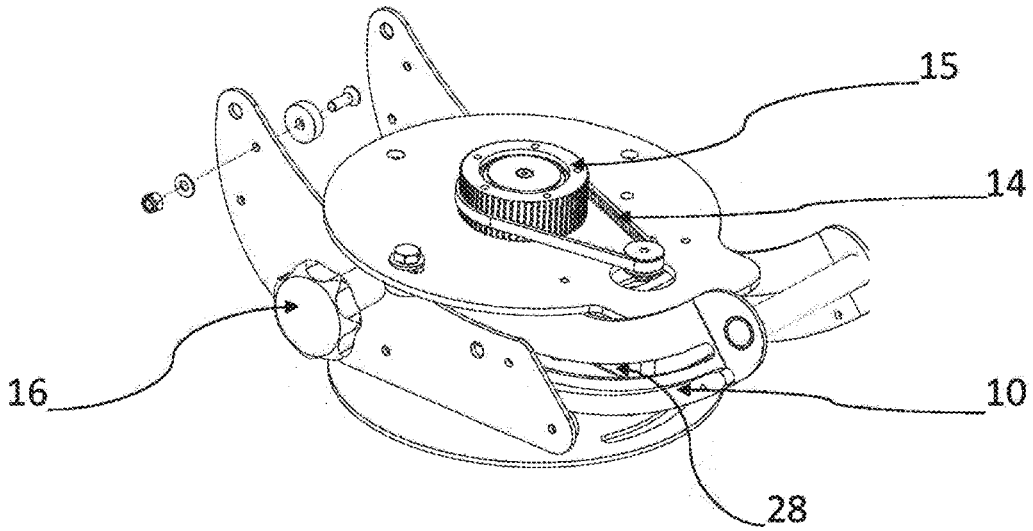
[Fig. 8]
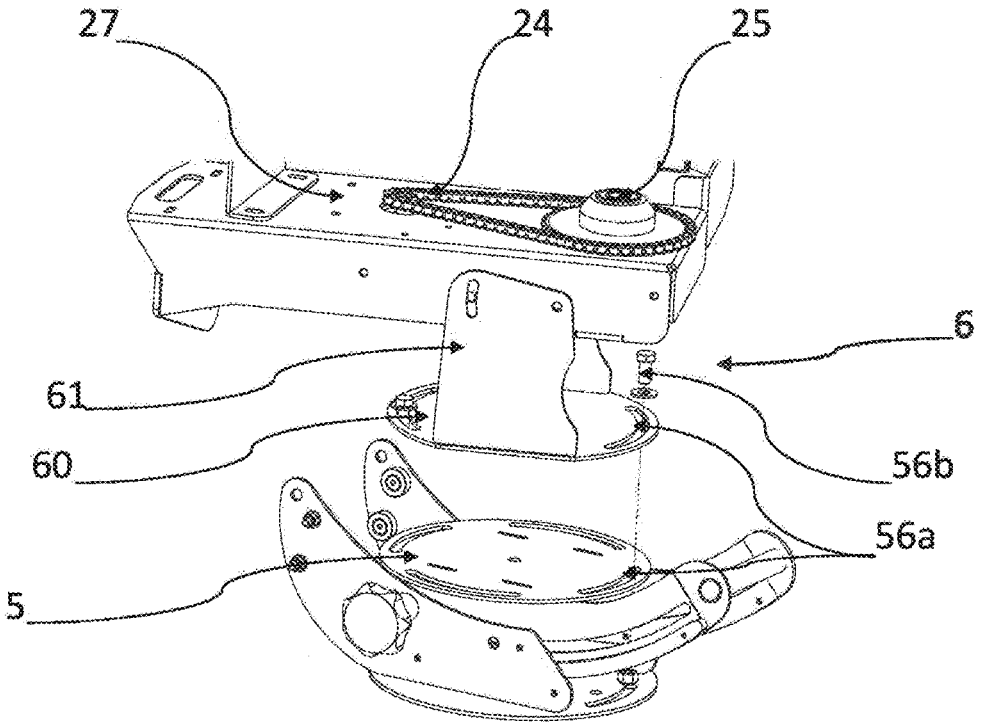

[Fig. 9]
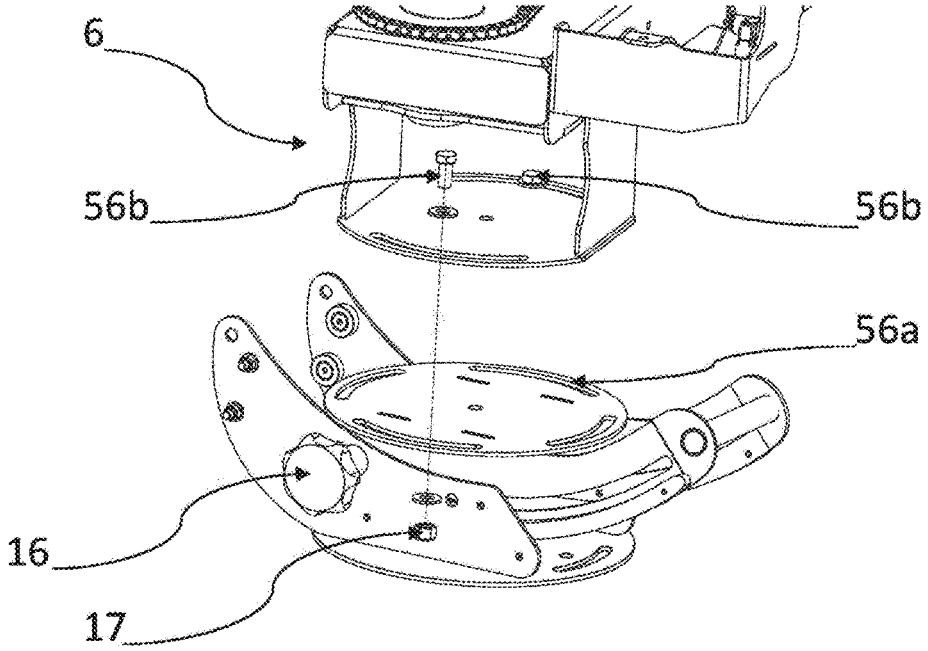

[Fig. 10]
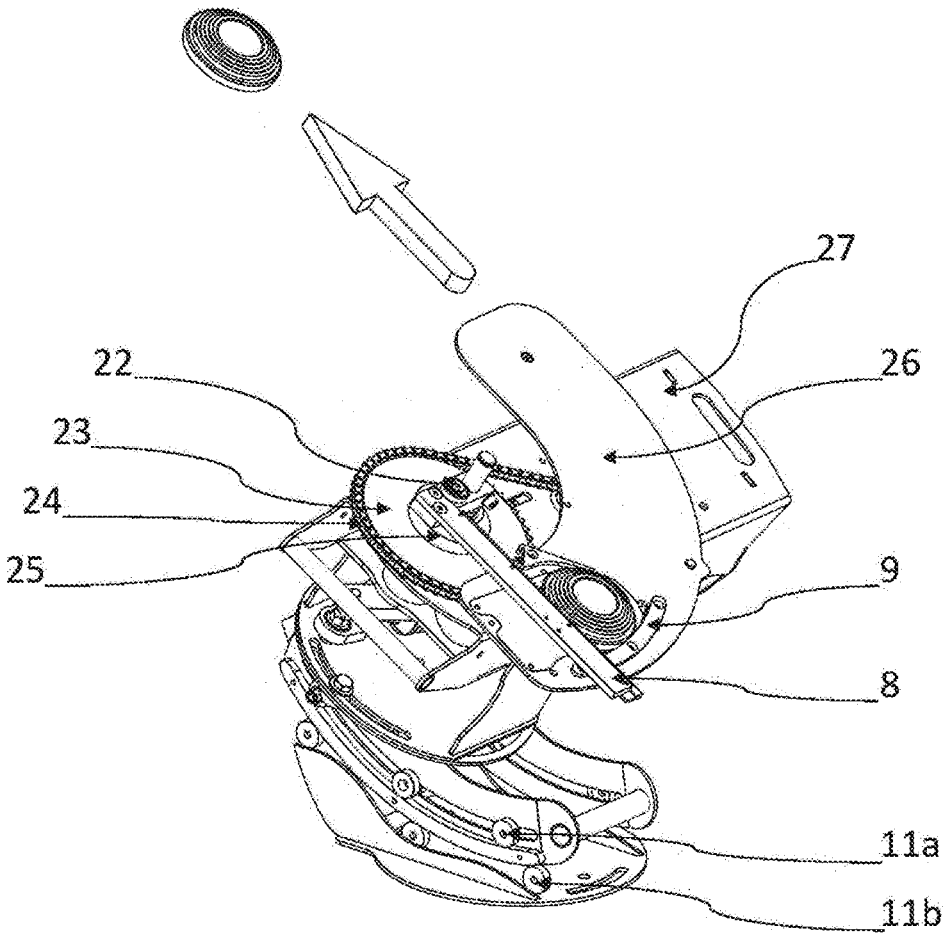

[Fig. 11]
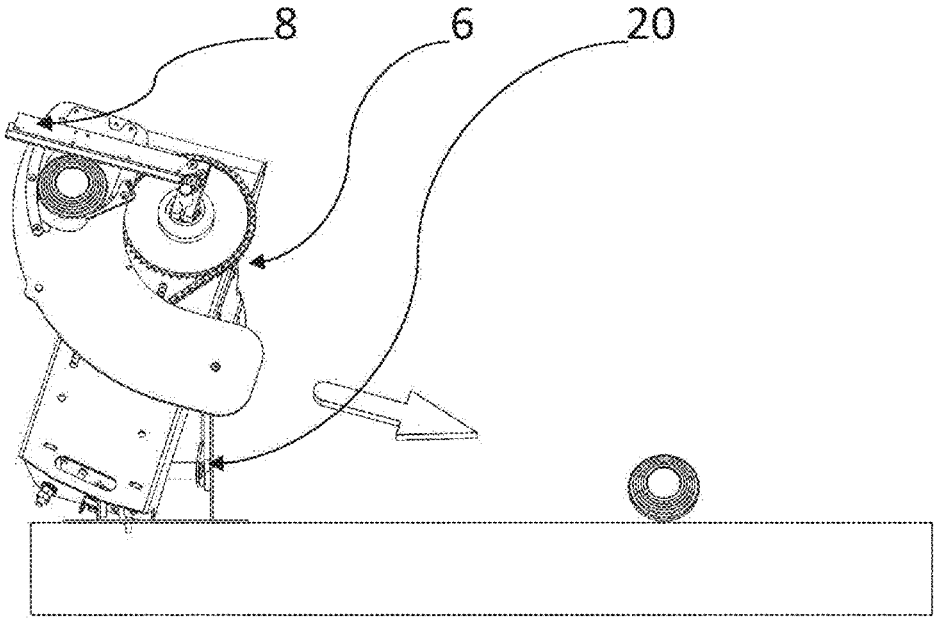
[Fig. 12A]
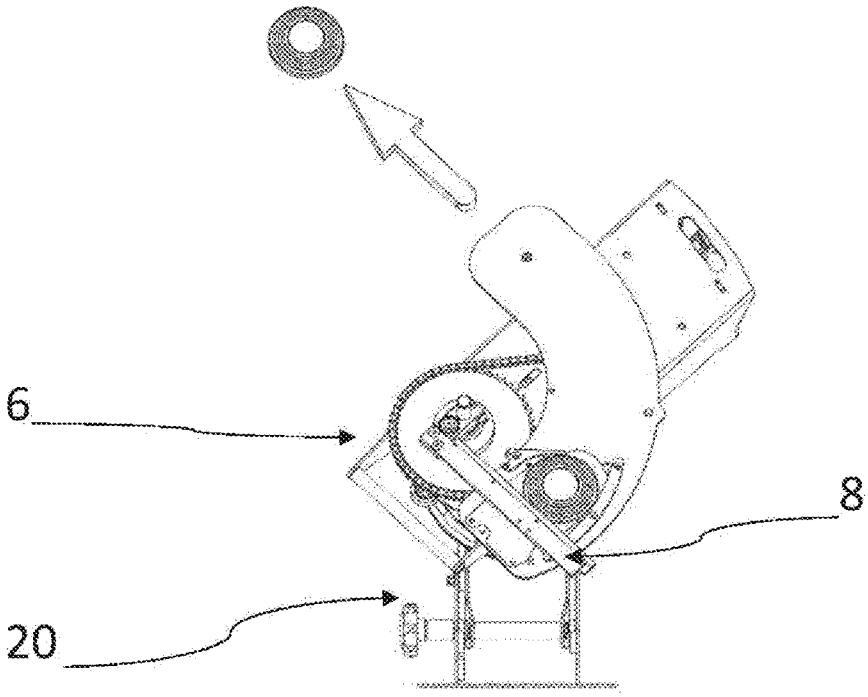

[Fig. 12B]
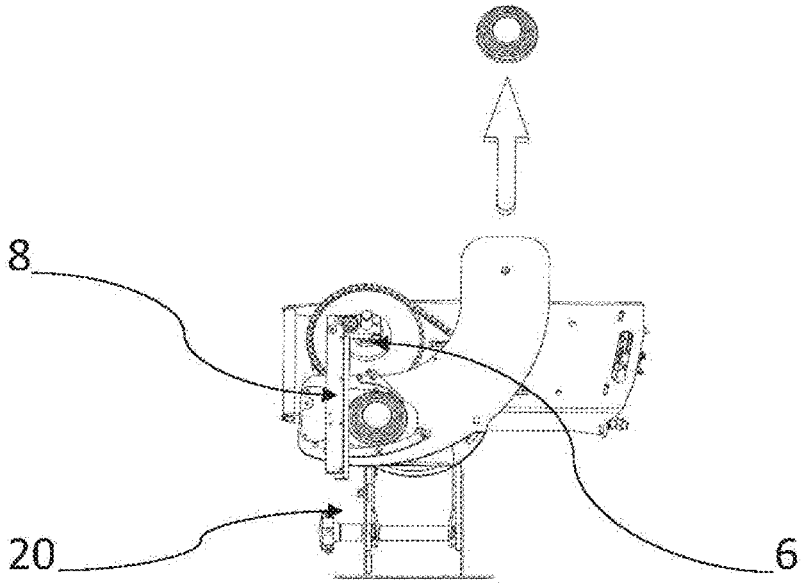
[Fig. 12C]
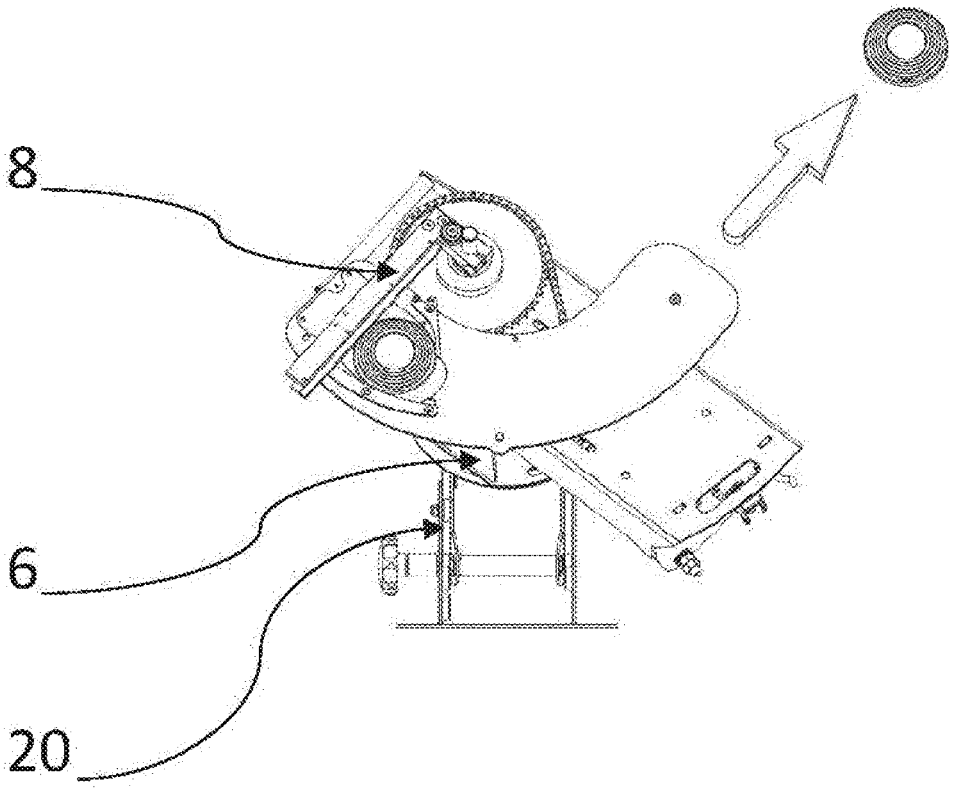

[Fig. 13A]
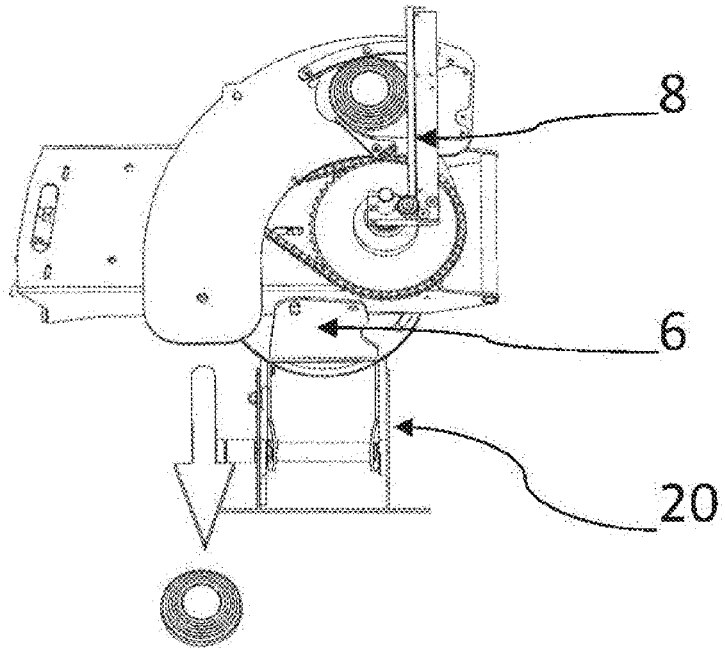
[Fig. 13B]
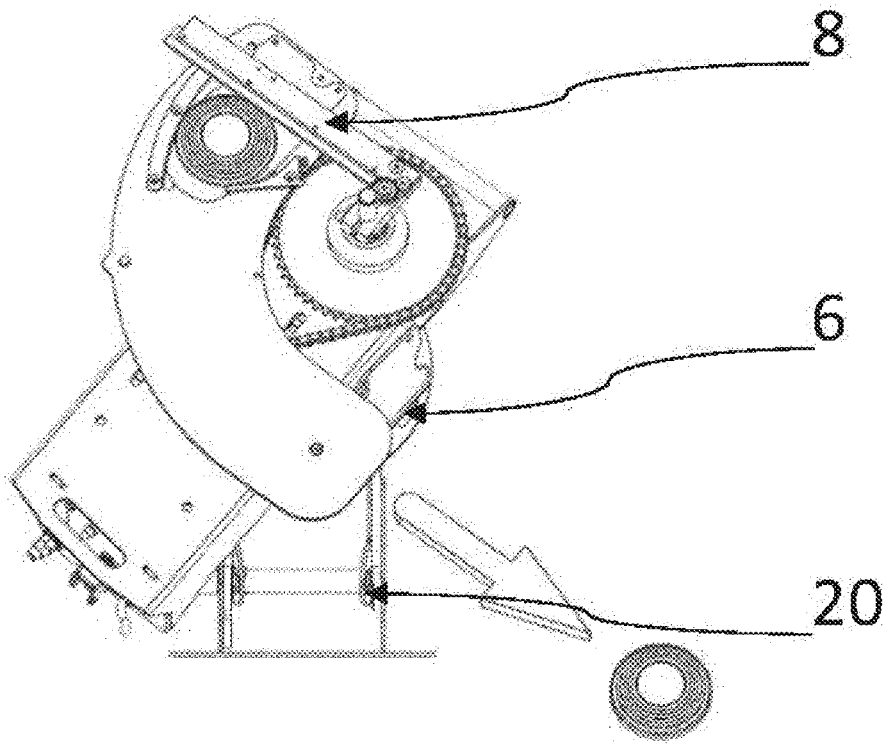

[Fig. 13C]
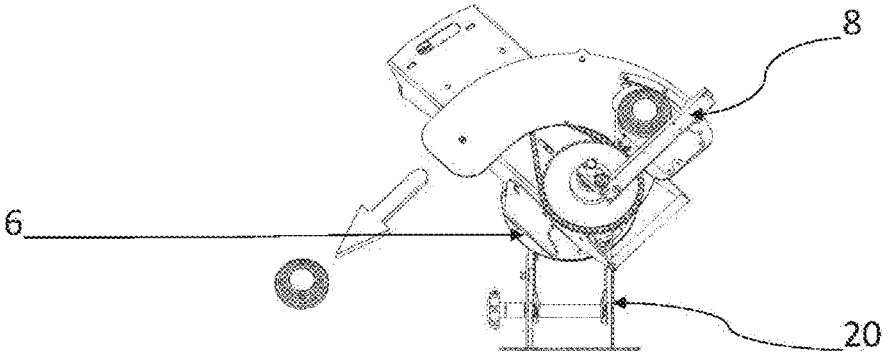
[Fig. 14A]
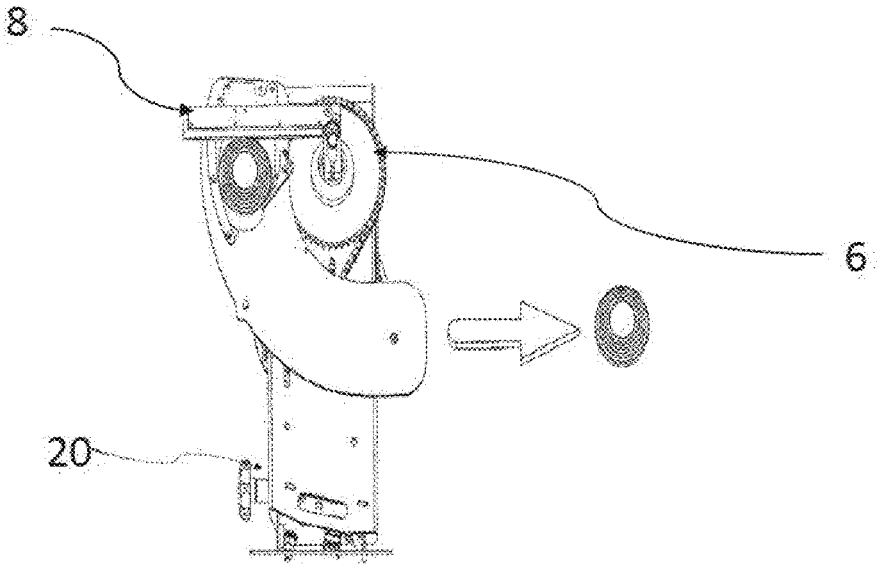

[Fig. 14B]
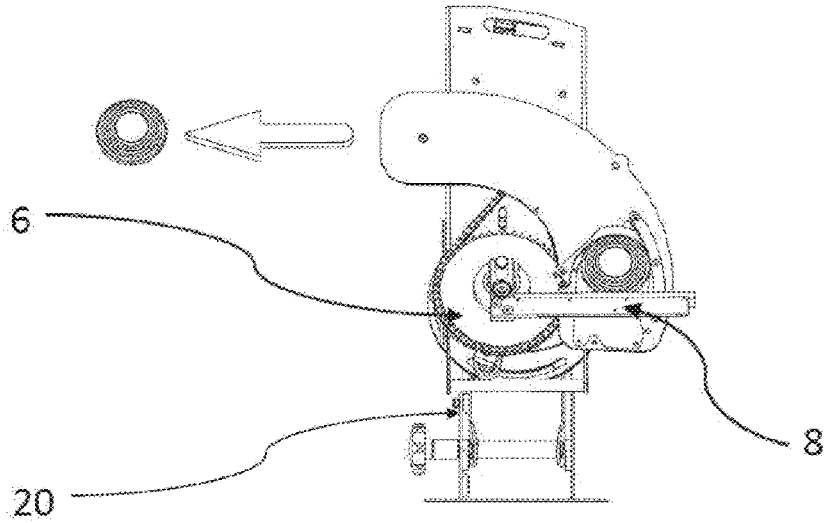

TARGET LAUNCHING MACHINE

TECHNICAL FIELD

The present application is a U.S. National Phase of International Application Number PCT/EP2020/062788, filed May 7, 2020, which claims priority to French Application No. 1904864, filed May 10, 2019.

The present invention relates in particular to a target launching machine.

A preferred application relates to the shooting sports industry, and more precisely the ball-trap industry.

PRIOR ART

The ball-trap environment is changing, proposing varied target trajectories. To do this, mechanisms provide launchers with adjustable orientations. In patent publication FR 3066813 A1 a target launching machine is known provided with a base surmounted with an assembly comprising a target launching mechanism and a drum for storing targets. This assembly is movable relative to the base. A tilting device is intended for allowing the inclination of the assembly relative to the base in order to allow for varied target shooting directions. This tilting device comprises on one hand a first portion linked to the base and comprising an engaged curved rail and an element guided by the rail in a single degree of freedom of tilting along the rail, and on the other hand a second portion connected to the assembly and comprising an element guided by the rail.

In a perspective to propose target launching machines that are increasingly effective, there exists the need to increase the possibilities of trajectories that can be accomplished by the target launching machine. The present invention proposes a target launching machine aimed at responding to this need.

SUMMARY

To achieve this objective, an embodiment provides a target launching machine comprising a base on which there an assembly is arranged comprising a launching mechanism and a drum for storing targets, assembly being configured so as to be able to move relative to the base, the machine comprising a tilting device that allows the assembly to move relative to the base, the tilting device comprising on one hand a first portion connected to the base and comprising one from among a curved rail and an element for guiding of the rail in a single degree of freedom of tilting along the rail, and on the other hand a second portion connected to the assembly and comprising the other from among the rail and the guiding element, characterised in that it comprises a pivot connection about a rotation axis A2 between the second portion and the rest of the assembly.

Thanks to this machine, the possibilities of orienting the launching system are multiplied, i.e. the launching trajectory of the target can be defined in a wide range including in inclination of the target relative to the horizontal. Contrary to the current machines, the present machine combines mobilities of a different nature, with in particular a mobility by tilting and a mobility by pivoting.

Another aspect of the present invention relates to a method for launching targets, wherein a tilting of the assembly is produced relative to the base and a pivoting of a base portion of the assembly relative to the rest of the assembly is produced. The adjusting of the tilting angle and of the pivoting angle makes it possible to fix the target launching position in a wide range of possibilities.

BRIEF DESCRIPTION OF THE FIGURES

The purposes and objects as well as the characteristics and advantages of the invention shall appear better in the detailed description of an embodiment of the latter which is shown in the following accompanying drawings wherein:

FIG. 1 shows the exterior view of a target launching machine of the present invention.

FIG. 2 shows an exterior view of the tilting device of the present invention according to a first embodiment.

FIG. 3 shows a profile view of FIG. 2.

FIG. 4 shows an inclined view of FIG. 2.

FIG. 5 shows a side view of the tilting device and of the turret of the present invention according to a second embodiment.

FIG. 6 shows the exterior view of the tilting device of the mode of the present invention according to FIG. 5.

FIG. 7 shows the exterior view of the tilting device of the present invention of FIG. 2.

FIG. 8 shows an exploded view of the target launching machine of the present invention according to a third embodiment.

FIG. 9 shows another exploded view of FIG. 8.

FIG. 10 shows an exterior view of the machine.

FIG. 11 shows the profile view of a target launching machine of the present invention in a configuration that authorises a trajectory of targets towards the ground.

FIG. 12A shows the profile view of a target launching machine of the present invention in a configuration that authorises an ascending trajectory of the target.

FIG. 12B shows the profile view of a target launching machine of the present invention in a configuration that authorises an ascending trajectory of the target.

FIG. 12C shows the profile view of a target launching machine of the present invention in a configuration that authorises an ascending trajectory of the target.

FIG. 13A shows the profile view of a target launching machine of the present invention in a configuration that authorises a descending trajectory of the target.

FIG. 13B shows the profile view of a target launching machine of the present invention in a configuration that authorises a descending trajectory of the target.

FIG. 13C shows the profile view of a target launching machine of the present invention in a configuration that authorises a descending trajectory of the target.

FIG. 14A shows the profile view of a target launching machine of the present invention in a configuration that authorises a horizontal trajectory of the target.

FIG. 14B shows the profile view of a target launching machine of the present invention in a configuration that authorises a horizontal trajectory of the target.

The drawings are given as examples and do not limit the invention. They form schematic block representations intended for facilitating the understanding of the invention and are not necessarily to scale of the practical applications.

DETAILED DESCRIPTION

Before beginning a detailed review of the embodiments of the invention, optional characteristics are mentioned hereinafter that can possibly be used in combination or alternatively:

According to an example, the pivot connection comprises a fixed base relative to the second portion and a turret adjustable in rotation on the fixed base.

This makes it possible to multiply the number of possible target shooting trajectories.

According to an example, one from among the fixed base and the turret comprises at least one oblong hole, and the other from among the fixed base and the turret comprises at least one guided finger in the at least one oblong hole.

This makes it possible to authorise a rotation of the turret relative to the fixed base.

According to an example, the one from among the fixed base and the turret that comprises at least one oblong hole comprises at least two oblong holes.

This makes it possible to increase the angular amplitude of the turret.

According to an example, the finger can be locked into position relative to the oblong hole.

This makes it possible to fix in an immobile position the assembly before the launching of a target.

According to an example, the machine comprises a motor drive system of the turret relative to the fixed base.

This makes it possible to limit the forces of carrying out the rotation of the turret relative to the fixed base manually.

According to an example, the turret comprises a movable base extending parallel to an upper face of the fixed base and two side uprights fixed on the movable base and carrying the launching mechanism and the drum.

According to an example, the tilting device comprises two parallel rails and two guiding elements, each one associated with a different one of the two rails.

According to an example, the axis of the pivot connection is located in a plane at an equal distance from the two rails.

This makes it possible to have a symmetric distribution of the forces exerted in the tilting mechanism.

According to an example, the motor is located between the two rails and under the fixed base.

This allows the machine to be smaller.

According to an example, the machine comprises a control system configured to control the tilting device and the pivot connection.

This allows the user to control the launching machine remotely.

According to an example, the pivot connection is configured in such a way as to allow a rotation of the assembly with an angular amplitude greater than 200°.

In what follows, a target launching device shall be described used for the shooting sport of the pigeon shooting type which therefore frequently uses clay targets. It should be underlined that the present invention is not limited by such a use and that it can relate to the launching of foam targets, for example intended for archery.

The term "carried" means that the two elements are kinematically engaged. All configurations that comply with this kinematic simultaneity fall within the scope of the invention. The two elements can be directly or indirectly connected.

The term "engaged" means an element that, in its operation, is linked either by contact, or through an intermediary to another member.

The invention shall now be described through embodiments of the figures.

The present invention describes a target launching machine comprising an assembly 1 and a base 2. It can be seen in FIG. 1 that the assembly 1 comprises a target launching mechanism 7 and a drum 4 for storing targets. The assembly 1 is movable relative to the base 2.

The drum 4 is typically an assembly of columns directed in parallel and each able to receive targets as a stack. The drum 4 can be mounted in rotation along the direction of the column in such a way as to participate in the sequential delivery of the targets on a launching zone.

In order allow for varied target shooting directions, the machine comprises a tilting device 20 intended for allowing the inclination of the assembly 1 relative to the base 2. The tilting device 20 comprises on the one hand a first portion linked to the base 2 and on the other hand a second portion connected to the assembly 1.

The tilting device 20 is particularly described through FIGS. 2 to 4 and 7 according to a first embodiment. The tilting device 20 is configured to allow for a mobility of the assembly 1 relative to the base 2 according to one degree of freedom, advantageously a sliding along a curve C1 defined by the shape of the tilting device 20. The tilting device 20 is advantageously configured to allow for a displacement of the assembly 1 with respect to the base 2. The tilting amplitude can be greater than 45°.

For this, the tilting device 20 is located between two cheeks 3 of the base 2 mounted parallel to one another and substantially perpendicularly on a base of the base 2. The first portion of the tilting device 20 linked to the base 2 comprises one from among a curved rail 10 and an element for guiding of the rail 10 in a single degree of freedom of tilting along the rail 10, and the second portion of the tilting device 20 linked to the assembly 1 comprises the other from among the rail 10 and the guiding element.

The base 2 and the first portion of the tilting device 20 are engaged in such a way as to authorise one degree of freedom in tilting along the tilting device 20.

According to a preferred example, and such as shown in all the figures, the tilting device 20 comprises two parallel rails 10 and two guiding or guided elements each one associated with a different one of the two rails 10.

The guided element advantageously extends over the entire length of the rail 20 by defining a tilting curve. The rail 10 and the guided element are movably mounted relatively following the curve of the rail 10.

According to a preferred embodiment, the guided element has a series of rollers cooperating with the rail 10. The series of rollers is preferably engaged with the base 2. The series of rollers has for function to cooperate with the rail 10 in such a way as to facilitate and to guide the tilting of the tilting device 20. By way of a non-limiting example and such as shown in FIG. 10, a first series of rollers 11*a* is in contact with an upper face of the rail 10 and a second series of rollers 11*b* is in contact with a lower face of the rail 10.

According to a preferred embodiment, the machine comprises two guided elements, more precisely two series of rollers 11 engaged with the base 2.

The at least one curved rail 10 is engaged with one from among the assembly 1 or the base 2 in a single degree of freedom of tilting along the rail 10 and the element guided by the rail 10 is engaged with the other from among the assembly 1 or the base 2. This degree of freedom advantageously follows the curve C1. As the rail 10 is curved, the degree of freedom obtained is a tilting. If the rail 10 in an arc or a circle, the tilting has a circular trajectory. Thus the curve C1 defined by the rail 10 allows for the displacement of the assembly 1 along this curve C1. The assembly 1 can then advantageously be raised or lowered with respect to the base 2.

In order to authorise the tilting of the tilting mechanism 20, the machine can comprise a motor 28 that actuates at least one pinion 13 cooperating with at least one rack 12 extending laterally to the rail 10, in the same plane as the rail 10 and following the same curve C1 as the rail. Thus in order to participate in the tilting of the tilting device 20. Thus the user actuates by turning on the motor 28, the rotation of the pinion 13 which imprints a tilting movement according to the curve C1 of the rack 12 and therefore of the tilting device 20. For example, FIG. 2 shows this situation.

According to a second embodiment and such as shown through FIGS. 5, 6, 8 and 9, the user manually tilts the tilting device 20 so as to displace the assembly 1 in such a way as to modify the inclination thereof relative to the base 2. In addition, so as to fix the tilting device 20 in an immobile position, once the tilting device 20 is manually positioned by the user, the machine can comprise an actuator thumbwheel 16, which is located preferably on at least one of the two cheeks 13 of the base 2 in such a way as to allow for the tightening and the locking of the tilting device 20 with the base 2 in an immobile position.

In addition, in order to allow for varied target shooting directions, the machine also comprises a pivot connection according to a rotation axis A2 intended for participating in the rotation of the assembly 1 relative to the base 2. This pivot connection and all the elements required for the existence thereof shall be described through FIGS. 5 to 9.

The pivot connection comprises a fixed base 5 relative to the second portion and a turret 6 adjustable in rotation on the fixed base 5. The fixed base 5 is advantageously engaged with the base 2, precisely the fixed base 5 is engaged with the upper portion of the tilting device 20.

Such as shown in FIGS. 5, 8 and 9, the turret 6 can include a movable base 60 extending parallel to an upper face of the fixed base 5. In addition the turret 6 can include two side uprights 61 fixed on the movable base 60 and carrying the launching mechanism 7 and the drum 4.

According to a third embodiment and such as shown through FIGS. 7 to 10, in order to authorise the rotation of the turret 6 relative to the fixed base 5 according to this pivot connection, one from among the fixed base 5 and the turret 6 comprises at least one oblong hole 56*a*, wherein the other from among the fixed base 5 and the turret 6 comprises at least one guided finger 56*b* in the at least one oblong hole 56*a*. Generally, the one from among the fixed base 5 and the turret 6 that comprises at least one oblong hole 56*a* comprises at least two oblong holes 56*a*. This makes it possible to increase the angular amplitude of the rotation of the assembly 1. A first rotation path with two oblong holes of the same angular amplitude and placed in opposition about the axis A2 can be provided; as well as a second path, identical in design, but offset by 90° relative to the first path. This corresponds to the examples, for example to FIG. 7. The sum of the amplitudes of the angular sectors of two oblong holes offset by 90° determines the rotation capacity offered by the machine. For example the angular sector of an oblong hole can be greater than 60°.

The guided finger 56*b* is displaced in the oblong hole 5 in such a way as to cooperate in order to form a sliding pivot connection that authorises one degree of freedom in rotation. Thus this rotation of the turret 6 authorises the rotation of the assembly 1.

So as to lock the turret 6 in an immobile position before starting the launching mechanism 7 of a target, the finger 56*b* can be locked into position relative to the oblong hole 56*a*. For this, the machine comprises a nut 17 fixed to the fixed base 5 with a mobility in rotation along the fixing axis to the movable base 60. Thus the nut 17 makes it possible to lock the finger 56*b* in position.

The machine is then in an immobile position via the immobilisation of the pivot connection and the immobilisation of the tilting before proceeding with the launching of a target. Thus the trajectory of a target can be established prior to the launching.

By way of a non-limiting example, the pivot connection is configured in such a way as to allow a rotation of the assembly 1 with an angular amplitude greater than 200°.

According to an alternative embodiment and such as shown through FIGS. 5 and 6, the rotation of the turret 6 relative to the fixed base 5 is controlled by a motor drive system 28 of the turret 6, with for example at least one chain or a belt 14, and at least one wheel 15. The motor 28 can be located between the two rails 20 such as is shown in FIG. 6. This makes the machine smaller. In addition, this makes it possible to retain a symmetry within the machine. The motor 28 is also advantageously located under the fixed base 5. It can be centred between the rails.

The fixed base 5 and the movable base 60 are preferably of circular shape.

The launching mechanism 7 of the machine is detailed in FIG. 10. Indeed, it can be seen there that the launching mechanism 7 comprises a motor (not shown) actuating a launching arm 8 intended for projecting the target located on a launching zone defined in part by a ruler 9. The target is positioned at mid-length of the launching arm 8 against the ruler 9. The motor (not shown) drives a drive pinion itself connected by a transmission of the chain 24 or belt type to a pinion 23 carried by a rotation shaft 22 such as shown in FIG. 10. In FIG. 10, it can be seen that a freewheel 25 of the rotation shaft 22 cooperates with the pinion 23. This launching zone is advantageously a portion of a launching plate 26. Preferably, the launching plate 26 is carried by a carrier plate 27, which is engaged with the launching mechanism 7. The rotation of the launching arm 8 is carried out advantageously in the anticlockwise direction with the freewheel 25 prohibiting any rotation of the arm 8 in the opposite direction.

Thus, the machine can authorise the mobility of the assembly 1 with respect to the base 2 along two degrees of freedom. These two degrees of freedom then follow a tilting along the curve C1 and a rotation along the rotation axis A2. To this effect, a high number of possible configurations of the assembly 1 is authorised with respect to the base 2, thus authorising a high number of different possible shooting trajectories.

These different possible configurations are described in FIGS. 11 to 13C.

FIG. 11 shows the machine, which is configured in such a way as to authorise the launching of the target towards the ground. The target is then made to roll along the ground. For this, the tilting mechanism 20 is in the so-called extreme configuration, which corresponds to a configuration wherein the tilting of the tilting mechanism 20 has reached its maximum height, and the turret 6 is configured in such a way as to orient the assembly 1 in such a way that the launching arm 8 is in an inclined position with respect to the base 2 to direct the target during the launching towards the ground. This makes it possible to project the target on the ground by offering a maximum surface of exposure. This configuration makes it possible to use the target launching machine for the use of so-called "Rabbit" models known in the industry of the ball-trap.

FIGS. 12A to 12C show the machine, which is configured in such a way as to authorise an ascending trajectory of the target. For this, the tilting mechanism 20 is preferably in the extreme configuration and the turret 6 is preferably positioned in such a way that the launching arm 8 is either perpendicular with respect to the ground before the launching of the target, the arm 8 having a free end oriented towards the ground such as shown in FIG. 12B; or inclined with respect to an axis perpendicular to the ground such as shown in FIGS. 12A and 12C.

FIGS. 13A to 13C show the machine, which is configured in such a way as to authorise a descending trajectory of the target. For this, the tilting mechanism 20 is preferably in the extreme configuration, and the turret 6 is preferably positioned in such a way that the launching arm 8 is either perpendicular with respect to the ground before the launching of the target, the arm 8 having a free end oriented opposite the ground such as shown in FIG. 13A; or inclined with respect to an axis perpendicular to the ground.

FIGS. 14A and 14B show the machine, which is configured in such a way as to authorise a horizontal trajectory of the target. For this, the tilting mechanism 20 is preferably in the extreme configuration and the turret 6 is preferably positioned in such a way that the launching arm 8 is parallel with respect to the ground before the launching of the target.

The invention is not limited to the embodiments described hereinabove and extends to all the embodiments covered by the claims.

LIST OF REFERENCES

1 Assembly
2 Base
3 Cheeks of the base
4 Drum
5 Fixed base
6 Turret
60 Movable base
61 Side uprights
56*a* Oblong hole
56*b* Protruding finger portion
7 Launching mechanism
8 Launching arm
9 Ruler
10 Rail
11*a* Roller
11*b* Roller
12 Rack
13 Pinion
14 Belt
15 Wheel
16 Actuator thumbwheel
17 Nut
20 Tilting device
22 Rotation shaft
23 Pinion
24 Chain
25 Freewheel
26 Launching plate
27 Carrier plate
28 Motor
A2 Rotation axis of the turret
C1 Curve of the rail

The invention claimed is:

1. A target launching machine comprising:
a base on which there is arranged an assembly comprising:
a launching mechanism and a drum for storing targets, the assembly being movable relative to the base,
a tilting device configured to allow the assembly to move relative to the base, the tilting device comprising:
a first portion connected to the base and comprising one from among:
a curved rail; and
a guiding element for guiding of the curved rail in a single degree of freedom of tilting along the curved rail; and
a second portion connected to the assembly and comprising the other from among:
the curved rail; and
the guiding element; and
a first pivot connection about a rotation axis A2 between the second portion and of the assembly wherein the first pivot connection includes:
a fixed base relative to the second portion and a turret adjustable in rotation with a second pivot connection on the fixed base and
wherein the turret includes a movable base extending parallel to an upper face of the fixed base and two side uprights fixed on the movable base and carrying the launching mechanism and the drum, wherein the first and second pivot connection are different.

2. The machine according to claim 1, wherein one from among the fixed base and the turret comprises:
at least one oblong hole, and wherein the other from among the fixed base and the turret comprises at least one guided finger in the at least one oblong hole.

3. The machine according to claim 2, wherein the one from among the fixed base and the turret comprises:
the at least one oblong hole comprises at least two oblong holes.

4. The machine according to claim 3, wherein the one guided finger is lockable into position relative to the oblong hole.

5. The machine according to claim 1, further comprising:
a motor drive system of the turret relative to the fixed base.

6. The machine according to claim 5, wherein the tilting device comprises two parallel rails and two guiding elements, each guiding element associated with a different one of the two parallel rails and wherein the motor drive system is located between the two parallel rails and under the fixed base.

7. The machine according to claim 1, wherein the tilting device includes two parallel rails and two guiding elements each guiding element associated with a different one of the two parallel rails.

8. The machine according to claim 7, wherein the rotation axis A2 of the first pivot connection is located in a plane at an equal distance from the two parallel rails.

9. The machine according to claim 1, further comprising:
a control system configured to control the tilting device and the first pivot connection.

10. The machine according to claim 1, wherein the first pivot connection is configured to allow a rotation of the assembly with an angular amplitude greater than 200°.

11. A target launching machine, comprises:
a base;
an assembly arranged on the base and being movable relative to the base, the assembly includes:
a launching mechanism; and
a drum for storing targets,
a tilting device configured to allow the assembly to move relative to the base, the tilting device includes:
a first portion connected to the base and including one of:
a curved rail; and a guiding element for guiding of the curved rail in a single degree of tilting freedom along the curved rail; and a second portion connected to the assembly and including one of:

the curved rail in response to the first portion including the guiding element; and the guiding element in response to the first portion including the curved rail; and a first pivot connection about a rotation axis between the second portion and the assembly wherein the first pivot connection includes:

a fixed base relative to the second portion; and a rotationally adjustable turret with a second pivot connection on the fixed base; and wherein the rotationally adjustable turret includes a movable base extending parallel to an upper face of the fixed base and two side uprights fixed on the movable base and carrying the launching mechanism and the drum, wherein the first and second pivot connection are different.

* * * * *